US007865104B2

(12) United States Patent
Kodimer

(10) Patent No.: US 7,865,104 B2
(45) **Date of Patent: *Jan. 4, 2011**

(54) SYSTEM AND METHOD FOR GENERATING A USER CUSTOMIZABLE DEFAULT USER INTERFACE FOR A DOCUMENT PROCESSING DEVICE

(75) Inventor: Marianne Kodimer, Huntington Beach, CA (US)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/755,448

(22) Filed: Apr. 7, 2010

(65) Prior Publication Data

US 2010/0192080 A1 Jul. 29, 2010

Related U.S. Application Data

(63) Continuation of application No. 11/626,825, filed on Jan. 24, 2007, now Pat. No. 7,729,630.

(51) Int. Cl.
*G03G 15/00* (2006.01)

(52) U.S. Cl. ..... 399/81; 399/80

(58) Field of Classification Search ..... 399/80–83
See application file for complete search history.

(56) References Cited

U.S. PATENT DOCUMENTS 7,729,630 B2 * 6/2010 Kodimer ..... 399/81
2007/0002368 A1 * 1/2007 Corona

* cited by examiner

*Primary Examiner*—Susan S Lee
(74) *Attorney, Agent, or Firm*—SoCal IP Law Group LLP; Steven C. Sereboff; Jonathan Pearce

(57) ABSTRACT

The subject application is directed to a system and method for generating a user customizable default user interface for a document processing device. First, screen data representing each of a plurality of different user interfaces is stored. Each user interface includes visual representations of a unique subset of controls associated with operation of the associated document processing device. Identification data is then acquired from an associated user. A display is generated representing each of the different user interfaces. Selection data representing a selected user interface as a default user interface is then received. Data associating the default user interface with the identification data is stored. Thereafter, a display is generated of the default user interface upon login of the associated user on the document processing device.

15 Claims, 10 Drawing Sheets

SYSTEM AND METHOD FOR GENERATING A USER CUSTOMIZABLE DEFAULT USER INTERFACE FOR A DOCUMENT PROCESSING DEVICE

CROSS-REFERENCE TO RELATED APPLICATIONS

This application is a continuation of U.S. patent application Ser. No. 11/626,825, filed Jan. 24, 2007 now U.S. Pat. No. 7,729,630.

BACKGROUND OF THE INVENTION

The subject application is directed to a system and method for generating a user customizable default user interface for a document processing device. More particularly, the subject application is directed to a system and method for users to select a user interface that addresses that user's particular needs and frequently accessed functions.

Today's document processing machines, such as copiers, printers, facsimile machines, and the like, are extremely powerful and versatile. Users can select functions such as collating, numbers of copies, stapling, distribution lists, paper size, paper type, color rendering, black and white rendering, and specified transmission times, as well as a myriad of other functions or combinations thereof. While powerful, current machines are relatively easy to use and control by virtue of intuitive user interfaces, such as is typically found on a display associated with a document processing device. By way of example, some document processing devices employ touch screen interfaces, such as a touch sensitive liquid crystal display ("LCD"), on which icons or text buttons are placed according to available functions.

A generalized user interface will allow all functions to be addressed. However, individual needs differ among users, which users will typically use a subset of available functions substantially more often than others. While customizable user interfaces exist, it is typically difficult or time consuming for a user to create one. Given these barriers, many users will forgo the benefits of a customized user interface, choosing instead to wade inefficiently through a general user interface each time a document processing device is used.

SUMMARY OF THE INVENTION

In accordance with one embodiment of the subject application, there is provided a system and method for generating a user customizable default user interface for a document processing device.

Further, in accordance with one embodiment of the subject application, there is provided a system and method for users to select a user interface that addresses that user's particular needs and frequently accessed functions.

Still further, in accordance with one embodiment of the subject application, there is provided a system for generating a user customizable default user interface for a document processing device. The system comprises a memory adapted for storage of screen data representative of each a plurality of different user interfaces, each user interface including visual representations of a unique subset of controls associated with operation of an associated document processing device. The system also comprises means adapted for acquiring identification data from an associated user, means adapted for generating a display representative of each of the plurality of user interfaces, and means adapted for receiving selection data representative of a selected one of the plurality of user interfaces as a default user interface. The system also comprises storage means adapted for storing data associating the default user interface with acquired identification data and means adapted for generating a display of the default user interface upon login of the associated user on the associated document processing device.

In one embodiment of the subject application, the system further comprises means adapted for displaying data representative of customizable sub-areas of the default user interface. The system also comprises means adapted for receiving, from the associated user, customization data representative of a modification to at least one of the customizable sub-areas and means adapted for generating a modified default user interface in accordance with received customization data.

In another embodiment of the subject application, the system further comprises means adapted for cycling each of the plurality different user interfaces on an associated display prior to receipt of selection data.

In further embodiment of the subject application, the customization data includes data representative of a selection of alternative icons associated with functions of the document processing device.

In yet another embodiment of the subject application, the customization data includes text data associated with the default user interface.

Still further, in accordance with one embodiment of the subject application, there is provided a method for generating a user customizable default user interface for a document processing device in accordance with the system as set forth above.

Still other advantages, aspects and features of the subject application will become readily apparent to those skilled in the art from the following description wherein there is shown and described a preferred embodiment of the subject application, simply by way of illustration of one of the best modes best suited to carry out the subject application. As it will be realized, the subject application is capable of other different embodiments and its several details are capable of modifications in various obvious aspects all without departing from the scope of the subject application. Accordingly, the drawings and descriptions will be regarded as illustrative in nature and not as restrictive.

BRIEF DESCRIPTION OF THE DRAWINGS

The subject application is described with reference to certain figures, including.

DETAILED DESCRIPTION OF THE PREFERRED EMBODIMENT

The subject application is directed to a system and method for generating a user customizable default user interface for a document processing device. In particular, the subject application is directed to a system and method for users to select a user interface that addresses that user's particular needs and frequently accessed functions. It will become apparent to those skilled in the art that the system and method described herein are suitably adapted to a plurality of varying electronic fields employing user interfaces, including, for example and without limitation, communications, general computing, data processing, document processing, or the like. The preferred embodiment, as depicted in FIG. 1, illustrates a document processing field for example purposes only and is not a limitation of the subject application solely to such a field.

Figure 1:
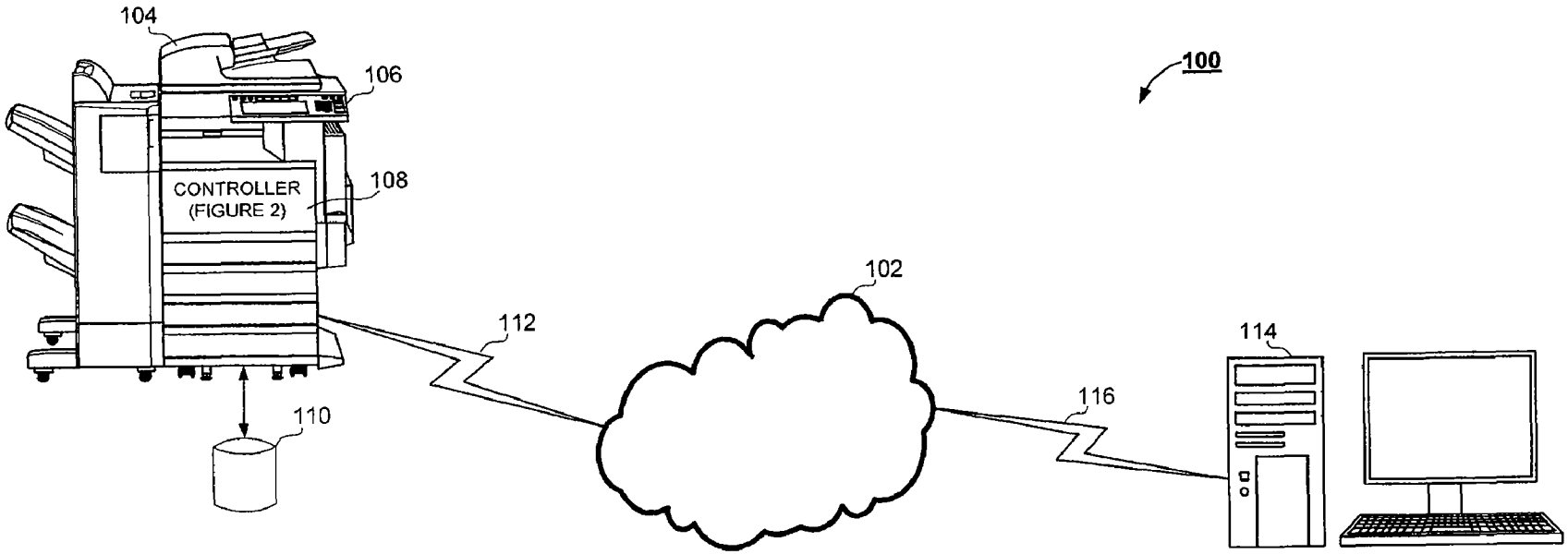
FIG. 1 is an overall diagram of the system for generating a user customizable default user interface for a document processing device according to one embodiment of the subject application.

Referring now to FIG. 1, there is shown an overall diagram of the system 100 for generating a user customizable default user interface for a document processing device in accordance with one embodiment of the subject application. As shown in FIG. 1, the system 100 is capable of implementation using a distributed computing environment, illustrated as a computer network 102. It will be appreciated by those skilled in the art that the computer network 102 is any distributed communications system known in the art capable of enabling the exchange of data between two or more electronic devices. The skilled artisan will further appreciate that the computer network 102 includes, for example and without limitation, a virtual local area network, a wide area network, a personal area network, a local area network, the Internet, an intranet, or the any suitable combination thereof. In accordance with the preferred embodiment of the subject application, the computer network 102 is comprised of physical layers and transport layers, as illustrated by the myriad of conventional data transport mechanisms, such as, for example and without limitation, Token-Ring, 802.11(x), Ethernet, or other wireless or wire-based data communication mechanisms. The skilled artisan will appreciate that while a computer network 102 is shown in FIG. 1, the subject application is equally capable of use in a stand-alone system, as will be known in the art.

The system 100 also includes a document processing device 104, depicted in FIG. 1 as a multifunction peripheral device, suitably adapted to perform a variety of document processing operations. It will be appreciated by those skilled in the art that such document processing operations include, for example and without limitation, facsimile, scanning, copying, printing, electronic mail, document management, document storage, or the like. Suitable commercially available document processing devices include, for example and without limitation, the Toshiba e-Studio Series Controller. In accordance with one aspect of the subject application, the document processing device 104 is suitably adapted to provide remote document processing services to external or network devices. Preferably, the document processing device 104 includes hardware, software, and any suitable combination thereof, configured to interact with an associated user, a networked device, or the like.

According to one embodiment of the subject application, the document processing device 104 is suitably equipped to receive a plurality of portable storage media, including, without limitation, Firewire drive, USB drive, SD, MMC, XD, Compact Flash, Memory Stick, and the like. In the preferred embodiment of the subject application, the document processing device 104 further includes an associated user interface 106, such as a touch-screen, LCD display, touch-panel, alpha-numeric keypad, or the like, via which an associated user is able to interact directly with the document processing device 104. In accordance with the preferred embodiment of the subject application, the user interface 106 is advantageously used to communicate information to the associated user and receive selections from the associated user. The skilled artisan will appreciate that the user interface 106 comprises various components, suitably adapted to present data to the associated user, as are known in the art. In accordance with one embodiment of the subject application, the user interface 106 comprises a display, suitably adapted to display one or more graphical elements, text data, images, or the like, to an associated user, receive input from the associated user, and communicate the same to a backend component, such as a controller 108, as explained in greater detail below. Further, in accordance with one embodiment of the subject application, the user interface 106 is suitably adapted to display a customizable user interface to an associated user, as will be further understood by those skilled in the art.

Preferably, the document processing device 104 is communicatively coupled to the computer network 102 via a suitable communications link 112. As will be understood by those skilled in the art, suitable communications links include, for example and without limitation, WiMax, 802.11a, 802.11b, 802.11g, 802.11(x), Bluetooth, the public switched telephone network, a proprietary communications network, infrared, optical, or any other suitable wired or wireless data transmission communications known in the art.

In accordance with one embodiment of the subject application, the document processing device 104 further incorporates a backend component, designated as the controller 108, suitably adapted to facilitate the operations of the document processing device 104, as will be understood by those skilled in the art. Preferably, the controller 108 is embodied as hardware, software, or any suitable combination thereof, configured to control the operations of the associated document processing device 104, facilitate the display of images via the user interface 106, direct the manipulation of electronic image data, and the like. For purposes of explanation, the controller 108 is used to refer to any myriad of components associated with the document processing device 104, including hardware, software, or combinations thereof, functioning to perform, cause to be performed, control, or otherwise direct the methodologies described hereinafter.

It will be understood by those skilled in the art that the methodologies described with respect to the controller 108 are capable of being performed by any general purpose computing system, known in the art, and thus the controller 108 is representative of such a general computing device and is intended as such when used hereinafter. Furthermore, the use of the controller 108 hereinafter is for the example embodiment only, and other embodiments, which will be apparent to one skilled in the art, are capable of employing the system and method for generating a user customizable default user interface for a document processing device of the subject application. The functioning of the controller 108 will better be understood in conjunction with the block diagrams illustrated in FIGS. 2 and 3, explained in greater detail below.

Communicatively coupled to the document processing device 104 is a data storage device 110. In accordance with the preferred embodiment of the subject application, the data storage device 110 is any mass storage device known in the art including, for example and without limitation, magnetic storage drives, a hard disk drive, optical storage devices, flash memory devices, or any suitable combination thereof. In the preferred embodiment, the data storage device 110 is suitably adapted to store a document data, image data, electronic database data, user preference data, a variety of homepages, user customization data, or the like. It will be appreciated by those skilled in the art that while illustrated in FIG. 1 as being a separate component of the system 100, the data storage device 110 is capable of being implemented as an internal storage component of the document processing device 104, a component of the controller 108, or the like, such as, for example and without limitation, an internal hard disk drive, or the like.

The system 100 illustrated in FIG. 1 further depicts a user device 114, in data communication with the computer network 102 via a communications link 116. It will be appreciated by those skilled in the art that the user device 114 is shown in FIG. 1 as a laptop computer for illustration purposes only. As will be understood by those skilled in the art, the user device 114 is representative of any personal computing device known in the art, including, for example and without limitation, a computer workstation, a personal computer, a personal data assistant, a web-enabled cellular telephone, a smart phone, a proprietary network device, or other web-enabled electronic device. The communications link 116 is any suitable channel of data communications known in the art including, but not limited to wireless communications, for example and without limitation, Bluetooth, WiMax, 802.11a, 802.11b, 802.11g, 802.11(x), a proprietary communications network, infrared, optical, the public switched telephone network, or any suitable wireless data transmission system, or wired communications known in the art. Preferably, the user device 114 is suitably adapted to generate and transmit electronic documents, document processing instructions, user interface modifications, user interface customization data, upgrades, updates, personalization data, or the like, to the document processing device 104, or any other similar device coupled to the computer network 102.

Figure 2:
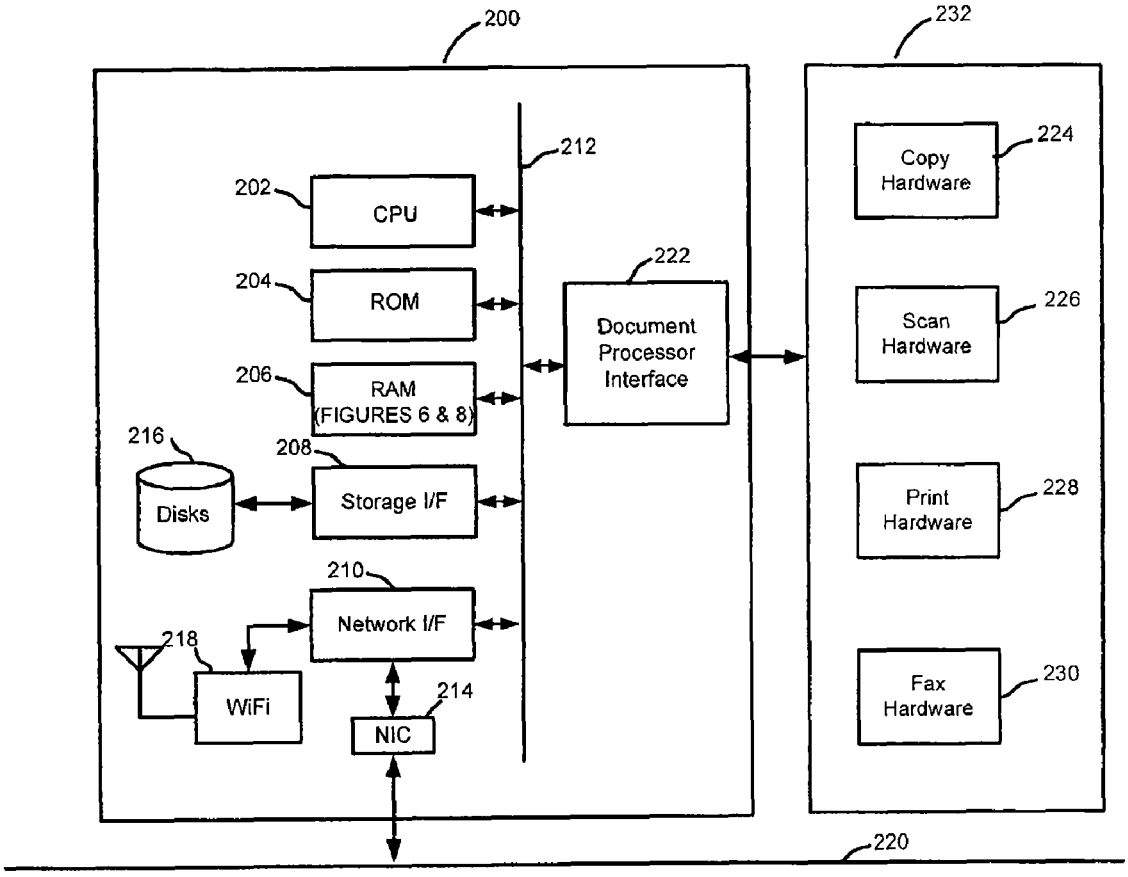
FIG. 2 is a block diagram illustrating controller hardware for use in the system for generating a user customizable default user interface for a document processing device according to one embodiment of the subject application.

Turning now to FIG. 2, illustrated is a representative architecture of a suitable backend component, i.e., the controller 200, shown in FIG. 1 as the controller 108, on which operations of the subject system 100 are completed. The skilled artisan will understand that the controller 108 is representative of any general computing device, known in the art, capable of facilitating the methodologies described herein. Included is a processor 202, suitably comprised of a central processor unit. However, it will be appreciated that processor 202 may advantageously be composed of multiple processors working in concert with one another as will be appreciated by one of ordinary skill in the art. Also included is a non-volatile or read only memory 204 which is advantageously used for static or fixed data or instructions, such as BIOS functions, system functions, system configuration data, and other routines or data used for operation of the controller 200.

Also included in the controller 200 is random access memory 206, suitably formed of dynamic random access memory, static random access memory, or any other suitable, addressable and writable memory system. Random access memory provides a storage area for data instructions associated with applications and data handling accomplished by processor 202.

A storage interface 208 suitably provides a mechanism for non-volatile, bulk or long term storage of data associated with the controller 200. The storage interface 208 suitably uses bulk storage, such as any suitable addressable or serial storage, such as a disk, optical, tape drive and the like as shown as 216, as well as any suitable storage medium as will be appreciated by one of ordinary skill in the art.

A network interface subsystem 210 suitably routes input and output from an associated network allowing the controller 200 to communicate to other devices. The network interface subsystem 210 suitably interfaces with one or more connections with external devices to the device 200. By way of example, illustrated is at least one network interface card 214 for data communication with fixed or wired networks, such as Ethernet, token ring, and the like, and a wireless interface 218, suitably adapted for wireless communication via means such as WiFi, WiMax, wireless modem, cellular network, or any suitable wireless communication system. It is to be appreciated however, that the network interface subsystem suitably utilizes any physical or non-physical data transfer layer or protocol layer as will be appreciated by one of ordinary skill in the art. In the illustration, the network interface 214 is interconnected for data interchange via a physical network 220, suitably comprised of a local area network, wide area network, or a combination thereof.

Data communication between the processor 202, read only memory 204, random access memory 206, storage interface 208 and the network interface subsystem 210 is suitably accomplished via a bus data transfer mechanism, such as illustrated by bus 212.

Also in data communication with bus the 212 is a document processor interface 222. The document processor interface 222 suitably provides connection with hardware 232 to perform one or more document processing operations. Such operations include copying accomplished via copy hardware 224, scanning accomplished via scan hardware 226, printing accomplished via print hardware 228, and facsimile communication accomplished via facsimile hardware 230. It is to be appreciated that the controller 200 suitably operates any or all of the aforementioned document processing operations. Systems accomplishing more than one document processing operation are commonly referred to as multifunction peripherals or multifunction devices.

Figure 3:
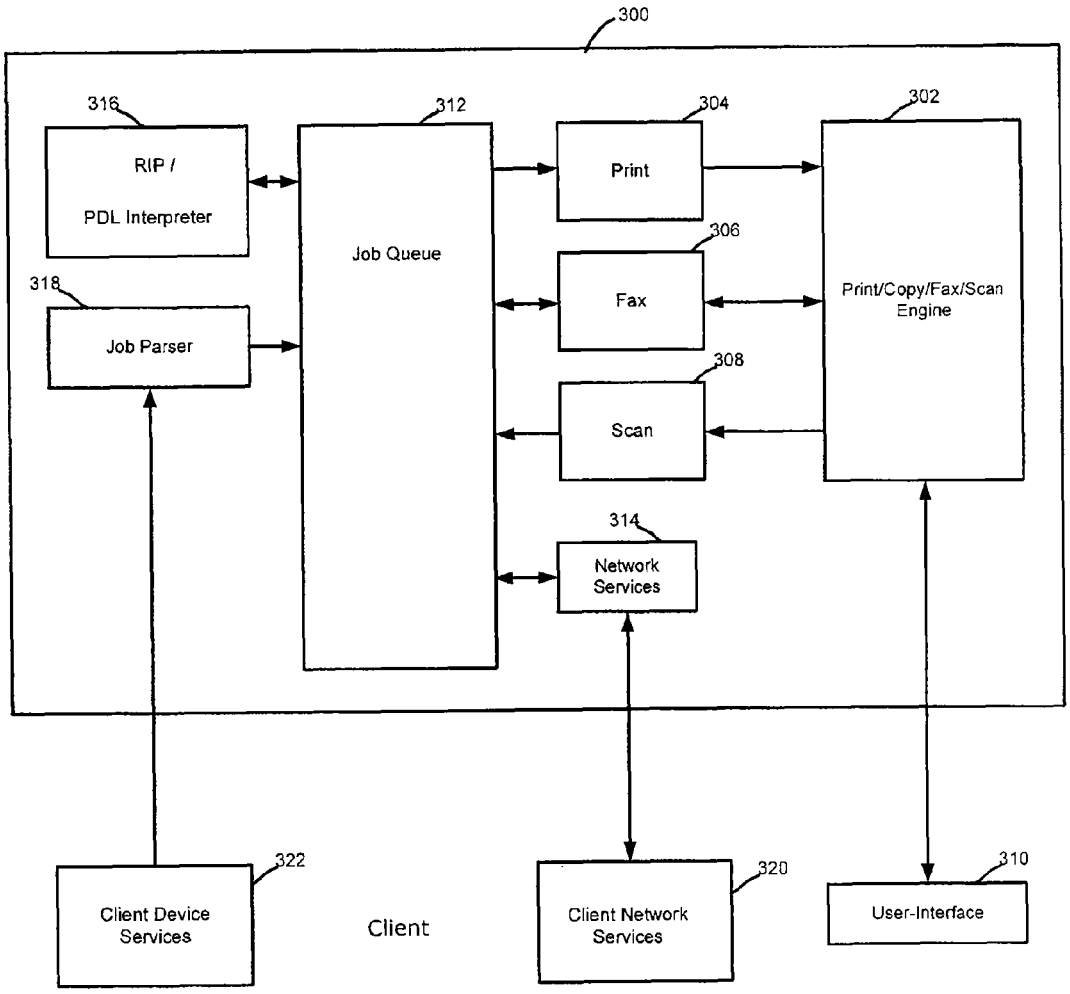
FIG. 3 is a functional diagram illustrating the controller for use in the system for generating a user customizable default user interface for a document processing device according to one embodiment of the subject application.

Functionality of the subject system 100 is accomplished on a suitable document processing device, such as the document processing device 104, which includes the controller 200 of FIG. 2, (shown in FIG. 1 as the controller 108) as an intelligent subsystem associated with a document processing device. In the illustration of FIG. 3, controller function 300 in the preferred embodiment, includes a document processing engine 302. A suitable controller functionality is that incorporated into the Toshiba e-Studio system in the preferred embodiment. FIG. 3 illustrates suitable functionality of the hardware of FIG. 2 in connection with software and operating system functionality as will be appreciated by one of ordinary skill in the art.

In the preferred embodiment, the engine 302 allows for printing operations, copy operations, facsimile operations and scanning operations. This functionality is frequently associated with multi-function peripherals, which have become a document processing peripheral of choice in the industry. It will be appreciated, however, that the subject controller does not have to have all such capabilities. Controllers are also advantageously employed in dedicated or more limited purposes document processing devices that are subset of the document processing operations listed above.

The engine 302 is suitably interfaced to a user interface panel 310, which panel allows for a user or administrator to access functionality controlled by the engine 302. Access is suitably enabled via an interface local to the controller, or remotely via a remote thin or thick client.

The engine 302 is in data communication with the print function 304, facsimile function 306, and scan function 308. These functions facilitate the actual operation of printing, facsimile transmission and reception, and document scanning for use in securing document images for copying or generating electronic versions.

A job queue 312 is suitably in data communication with the print function 304, facsimile function 306, and scan function 308. It will be appreciated that various image forms, such as bit map, page description language or vector format, and the like, are suitably relayed from the scan function 308 for subsequent handling via the job queue 312.

The job queue 312 is also in data communication with network services 314. In a preferred embodiment, job control, status data, or electronic document data is exchanged between the job queue 312 and the network services 314. Thus, suitable interface is provided for network based access to the controller function 300 via client side network services 320, which is any suitable thin or thick client. In the preferred embodiment, the web services access is suitably accomplished via a hypertext transfer protocol, file transfer protocol, uniform data diagram protocol, or any other suitable exchange mechanism. The network services 314 also advantageously supplies data interchange with client side services 320 for communication via FTP, electronic mail, TELNET, or the like. Thus, the controller function 300 facilitates output or receipt of electronic document and user information via various network access mechanisms.

The job queue 312 is also advantageously placed in data communication with an image processor 316. The image processor 316 is suitably a raster image processor, page description language interpreter or any suitable mechanism for interchange of an electronic document to a format better suited for interchange with device functions such as print 304, facsimile 306 or scan 308.

Finally, the job queue 312 is in data communication with a parser 318, which parser suitably functions to receive print job language files from an external device, such as client device services 322. The client device services 322 suitably include printing, facsimile transmission, or other suitable input of an electronic document for which handling by the controller function 300 is advantageous. The parser 318 functions to interpret a received electronic document file and relay it to the job queue 312 for handling in connection with the afore-described functionality and components.

Figure 4:
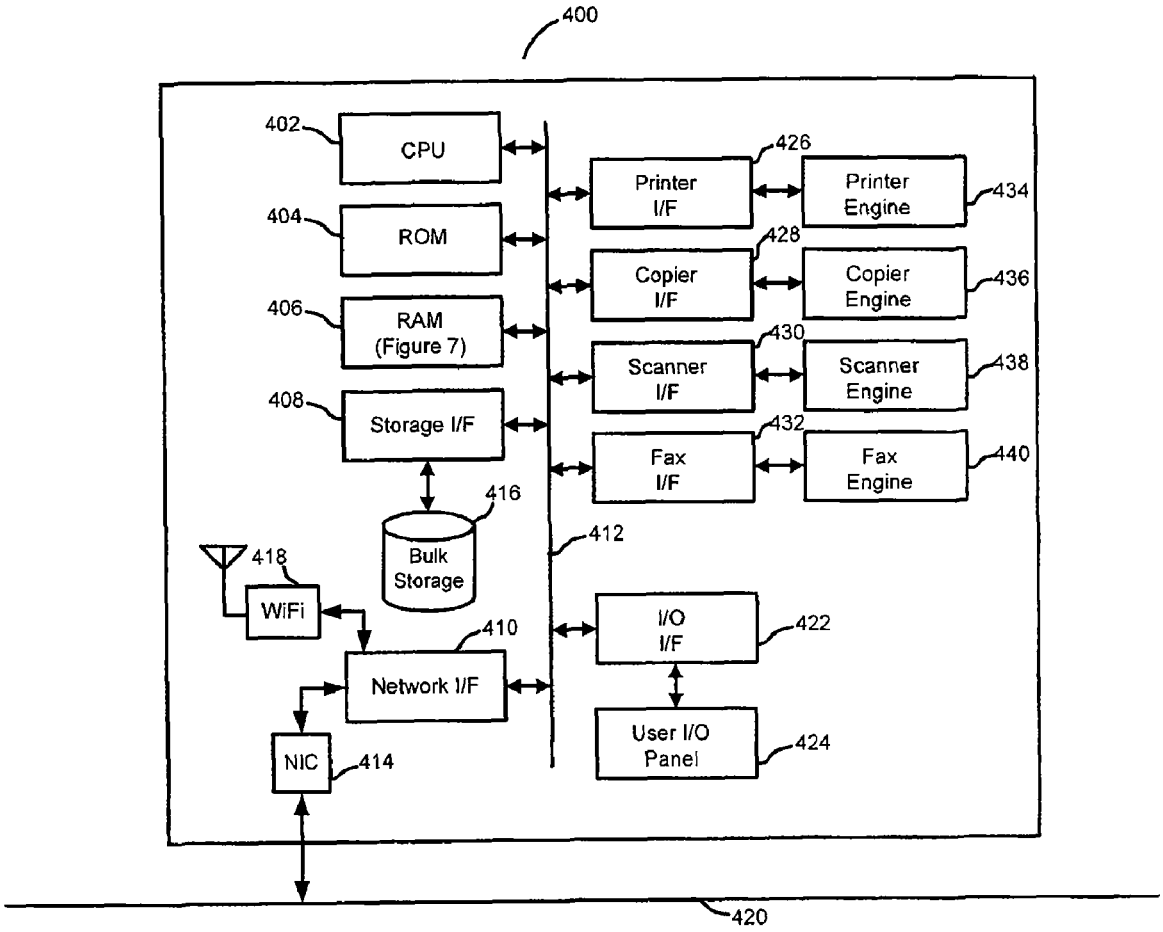
FIG. 4 is a block diagram illustrating device hardware for use in the system for generating a user customizable default user interface for a document processing device according to one embodiment of the subject application.

Turning now to FIG. 4, illustrated is a representative architecture of a suitable device 400, illustrated in FIG. 1 as the document processing device 104, on which operations of the subject system are completed. Included is a processor 402, suitably comprised of a central processor unit. However, it will be appreciated that the processor 402 may advantageously be composed of multiple processors working in concert with one another as will be appreciated by one of ordinary skill in the art. Also included is a non-volatile or read only memory 404 which is advantageously used for static or fixed data or instructions, such as BIOS functions, system functions, system configuration data, and other routines or data used for operation of the device 400.

Also included in the server 400 is random access memory 406, suitably formed of dynamic random access memory, static random access memory, or any other suitable, addressable memory system. Random access memory provides a storage area for data instructions associated with applications and data handling accomplished by the processor 402.

A storage interface 408 suitably provides a mechanism for volatile, bulk or long term storage of data associated with the device 400. The storage interface 408 suitably uses bulk storage, such as any suitable addressable or serial storage, such as a disk, optical, tape drive and the like as shown as 416, as well as any suitable storage medium as will be appreciated by one of ordinary skill in the art.

A network interface subsystem 410 suitably routes input and output from an associated network allowing the device 400 to communicate to other devices. The network interface subsystem 410 suitably interfaces with one or more connections with external devices to the device 400. By way of example, illustrated is at least one network interface card 414 for data communication with fixed or wired networks, such as Ethernet, token ring, and the like, and a wireless interface 418, suitably adapted for wireless communication via means such as WiFi, WiMax, wireless modem, cellular network, or any suitable wireless communication system. It is to be appreciated however, that the network interface subsystem suitably utilizes any physical or non-physical data transfer layer or protocol layer as will be appreciated by one of ordinary skill in the art. In the illustration, the network interface card 414 is interconnected for data interchange via a physical network 420, suitably comprised of a local area network, wide area network, or a combination thereof.

Data communication between the processor 402, read only memory 404, random access memory 406, storage interface 408 and the network subsystem 410 is suitably accomplished via a bus data transfer mechanism, such as illustrated by bus 412.

Suitable executable instructions on the device 400 facilitate communication with a plurality of external devices, such as workstations, document processing devices, other servers, or the like. While, in operation, a typical device operates autonomously, it is to be appreciated that direct control by a local user is sometimes desirable, and is suitably accomplished via an optional input/output interface 422 to a user input/output panel 424 as will be appreciated by one of ordinary skill in the art.

Also in data communication with bus 412 are interfaces to one or more document processing engines. In the illustrated embodiment, printer interface 426, copier interface 428, scanner interface 430, and facsimile interface 432 facilitate communication with printer engine 434, copier engine 436, scanner engine 438, and facsimile engine 440, respectively. It is to be appreciated that the device 400 suitably accomplishes one or more document processing functions. Systems accomplishing more than one document processing operation are commonly referred to as multifunction peripherals or multifunction devices.

Figure 5:
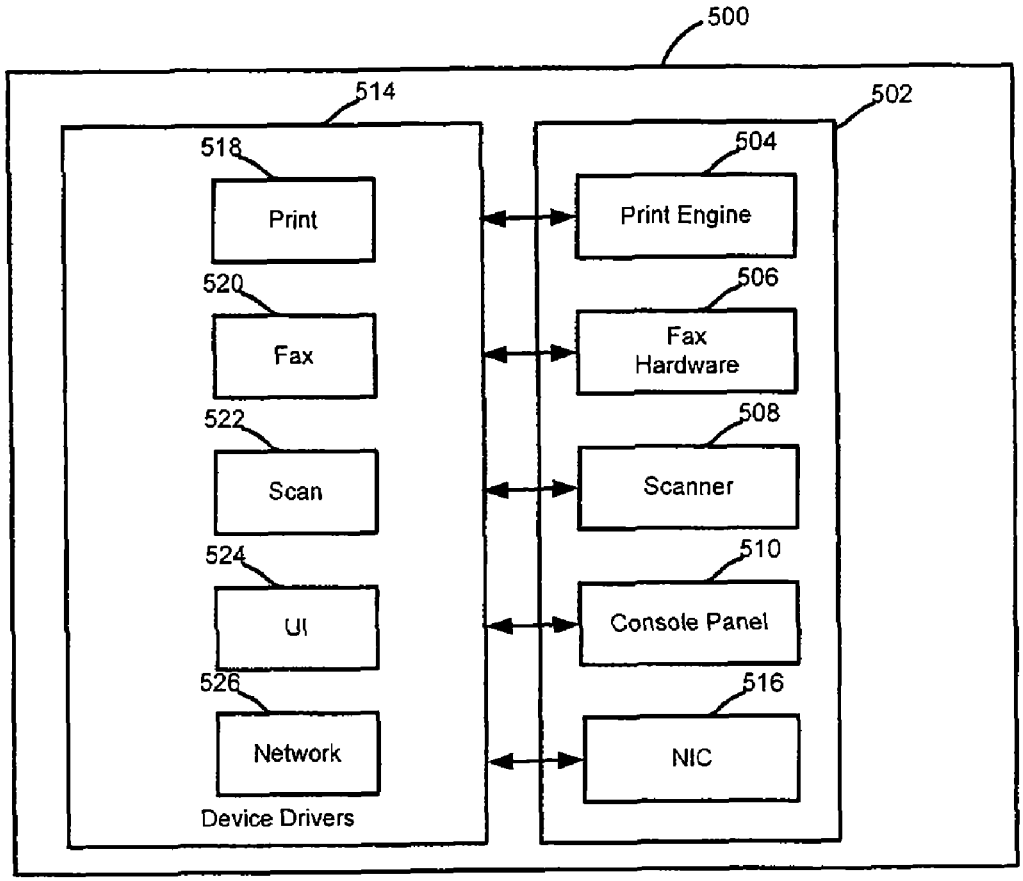
FIG. 5 is a functional diagram illustrating the device for use in the system for generating a user customizable default user interface for a document processing device according to one embodiment of the subject application.

Turning now to FIG. 5, illustrated is a suitable document processing device for use in connection with the disclosed system. FIG. 5 illustrates suitable functionality of the hardware of FIG. 4 in connection with software and operating system functionality as will be appreciated by one of ordinary skill in the art. The document processing device 500 suitably includes an engine 502 which facilitates one or more document processing operations.

The document processing engine 502 suitably includes a print engine 204, facsimile engine 206, scanner engine 508 and console panel 510. The print engine 504 allows for output of physical documents representative of an electronic document communicated to the processing device 500. The facsimile engine 506 suitably communicates to or from external facsimile devices via a device, such as a fax modem.

The scanner engine 508 suitably functions to receive hard copy documents and in turn image data corresponding thereto. A suitable user interface, such as the console panel 510, suitably allows for input of instructions and display of information to an associated user. It will be appreciated that the scanner engine 508 is suitably used in connection with input of tangible documents into electronic form in bitmapped, vector, or page description language format, and is also suitably configured for optical character recognition. Tangible document scanning also suitably functions to facilitate facsimile output thereof.

In the illustration of FIG. 5, the document processing engine also comprises an interface 516 with a network via driver 526, suitably comprised of a network interface card. It will be appreciated that a network thoroughly accomplishes that interchange via any suitable physical and non-physical layer, such as wired, wireless, or optical data communication.

The document processing engine 502 is suitably in data communication with one or more device drivers 514, which device drivers allow for data interchange from the document processing engine 502 to one or more physical devices to accomplish the actual document processing operations. Such document processing operations include one or more of printing via driver 518, facsimile communication via driver 520, scanning via driver 522 and a user interface functions via driver 524. It will be appreciated that these various devices are integrated with one or more corresponding engines associated with the document processing engine 502. It is to be appreciated that any set or subset of document processing operations are contemplated herein. Document processors which include a plurality of available document processing options are referred to as multi-function peripherals.

In operation, screen data representing each of a plurality of different user interfaces is stored. Preferably, each user interface includes visual representations of a unique subset of controls associated with operation of an associated document processing device 104. Identification data is then acquired from an associated user. A display is generated representing each of the different user interfaces. Selection data representing a selected user interface as a default user interface is then received. Data associating the default user interface with the identification data is then stored. Thereafter, a display is generated of the default user interface upon login of the associated user on the document processing device 104.

In accordance with one example embodiment of the subject application, data representative of a plurality of user interface screens is stored on the data storage device 110 associated with the document processing device 104. Preferably, each user interface screen includes visual representations of a unique subset of controls associated with operation of the associated document processing device 104. The skilled artisan will appreciate that the user interface screens are suitably adapted for display on the user interface 106 associated with the document processing device 104, or in accordance with one embodiment, are displayed via the user device 114 during remote access by the device 114 of the document processing device 104. In accordance with one embodiment of the subject application, the document processing device 104, via the associated controller 108 or other suitable backend component, facilitates the storage of multiple default home pages capable of being selected by a user for display on the user interface 106 upon logon by the user. As will be understood by those skilled in the art, the home page corresponds to the graphical user interface screen first displayed to the user upon successful login with respect to the document processing device 104.

Thus, the document processing device 104, via the user interface 106, or alternatively via the computer network 102 from the user device 114, acquires identification data associated with the identity of an associated user. As will be understood by those skilled in the art, suitable identification data includes, for example and without limitation, a username, a password, biometric data, an alphanumeric sequence, or any suitable combination thereof. The skilled artisan will appreciate that communication between the user device 114 and the document processing device 104 is accomplished via the computer network 102 using any suitable means known in the art, including, for example and without limitation, a web browser, web portal, dedicated software application, dedicated hardware link, or the like. Preferably, the controller 108, or other backend component of the document processing device 104, receives the identification data and authenticates the user via any suitable means known in the art.

Once the user has been verified, a determination is made whether there is a default interface screen associated with the identification data. That is, the controller 108 or other suitable backend component of the document processing device 104 searches the data storage device 110 for user interface screen data stored in association with the identification data. When a default user interface screen, e.g., a default home page, is located, it is retrieved and used to generate the display of the default interface, with any accompanying modifications, as will be discussed in greater detail below. It will be appreciated by those skilled in the art that when the identification data is received by the document processing device 104 directly via user interaction with the user interface 106, the user interface 106 displays the default home page to the user. Similarly, when the user identification data is received by the document processing device 104 via the computer network 102, the display associated with, for example the user device 114, facilitates the generation of the default home page to the user.

When the controller 108, or other suitable backend component of the document processing device 104 determines that no default user interface screen is associated with the received identification data, or when the user desires to modify the current default user interface screen, the first default user interface screen is retrieved from the data storage device 110. A display of the retrieved user interface screen is then generated on the user interface 106 for viewing and further customization by the user. In accordance with one embodiment, when accessing remotely via the user device 114, the first screen is transmitted via the computer network 102 to the user device 114 and displayed to the user thereon.

A determination is then made whether the user has selected the displayed interface screen as the user's default user interface. When the user has not selected the screen, e.g., has not made any changes within a predetermined period of time, or elects to continue to the next screen, the next interface screen is then cycled to in accordance with one embodiment of the subject application. Thereafter, the next user interface screen is retrieved from the storage device 110 and a display is generated of the user interface screen for viewing by the user. When the user has selected the current user interface screen displayed via the user interface 106 or suitable display of the user device 114, customizable sub-areas of the interface screen are displayed. It will be understood by those skilled in the art that suitable customizable areas include, for example and without limitation, selectable graphics elements, icons, text boxes, graphical buttons, or the like. These customizable sub-areas are suitably capable of being adapted in accordance with customization data that is received from the user. Thus, the user is able to select a particular icon, associate a document processing function with the icon, and a corresponding text description of the function associated with the icon.

A modified default interface, inclusive of the customization data received from the user, is then generated and stored on the data storage device 110. Preferably the controller 108 or other suitable backend component of the document processing device 104 stores the modified user interface data on the data storage device 110 in association with the identification data. Thereafter, each successive login of the user results in the generation of the modified default user interface screen associated with the identification data communicated during the user's login.

Figure 6:
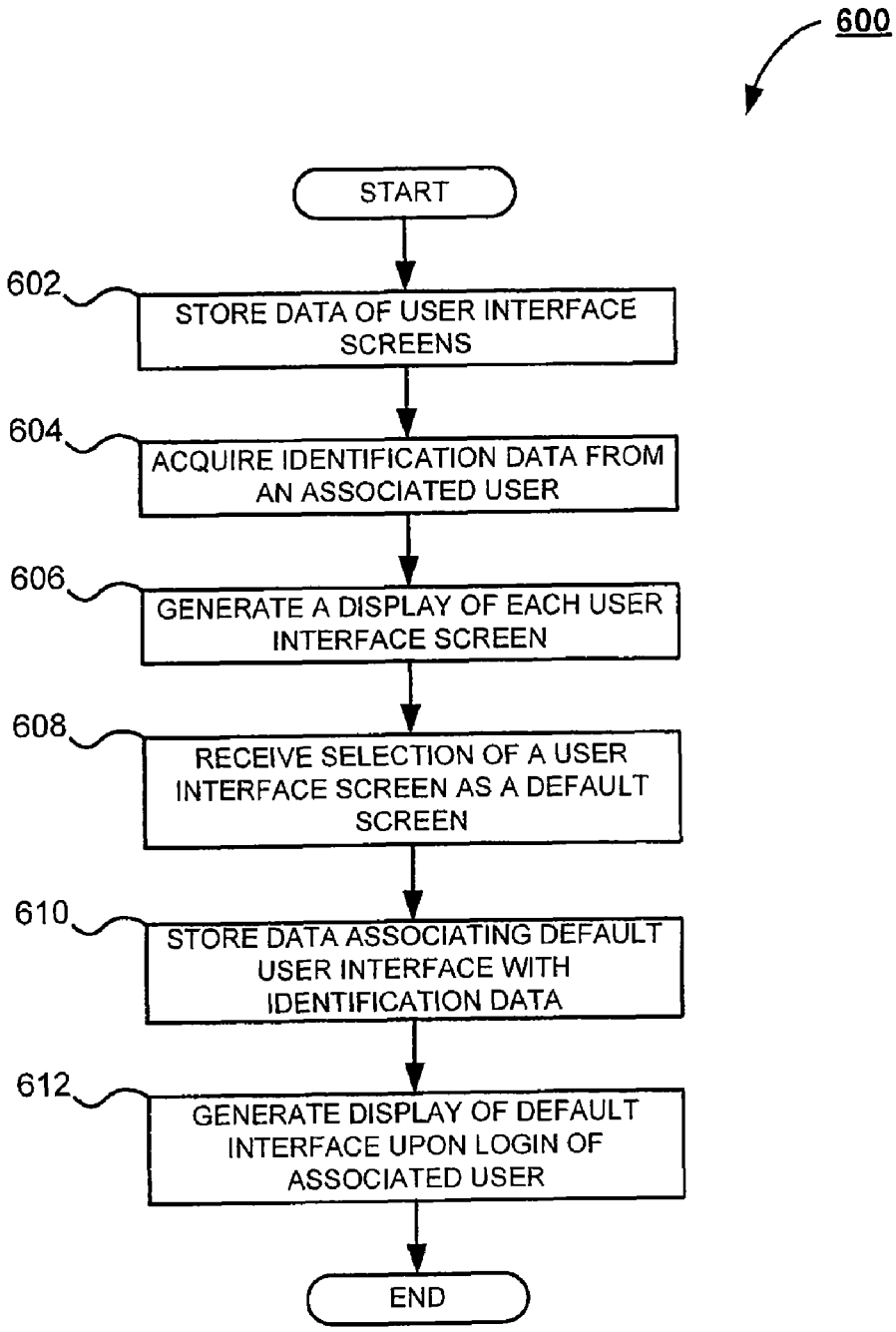
FIG. 6 is a flowchart illustrating a method for generating a user customizable default user interface for a document processing device according to one embodiment of the subject application.

The skilled artisan will appreciate that the subject system 100 and components described above with respect to FIG. 1, FIG. 2, FIG. 3, FIG. 4, and FIG. 5 will be better understood in conjunction with the methodologies described hereinafter with respect to FIG. 6 and FIG. 7, as well as the example interface screens illustrated in FIG. 8, FIG. 9, and FIG. 10. Turning now to FIG. 6, there is shown a flowchart 600 illustrating a method for generating a user customizable default user interface for a document processing device in accordance with one embodiment of the subject application. Beginning at step 602, data of a plurality of user interface screens is stored on the data storage device 110 associated with the document processing device 104. In accordance with one embodiment of the subject application, each user interface includes visual representations of a unique subset of controls associated with the operation of the associated document processing device 104. Suitable operations include, for example and without limitation, a copy operation, a print operation, a facsimile operation, a scan operation, an electronic mail operation, a storage operation, and the like.

Identification data is then acquired at step 604 from an associated user. It will be appreciated by those skilled in the art that suitable identification data includes, for example and without limitation, a username, a password, biometric data, an alphanumeric character stream, or the like. The skilled artisan will further appreciate that other methods of providing identification and authentication are capable of being employed in accordance with the subject application. A display of each user interface screen is then generated at step 606. In accordance with one embodiment of the subject application, each user interface screen is presented to the user for the selection of a default user interface screen. At step 608, a selection of one of the available user interface screens is received from the user for use as the default user interface screen. The selected user interface screen is then stored on the data storage device 110 at step 610 in association with the received user identification data. Thereafter, at step 612, a display of the default user interface screen is generated upon login of the associated user.

Figure 7:
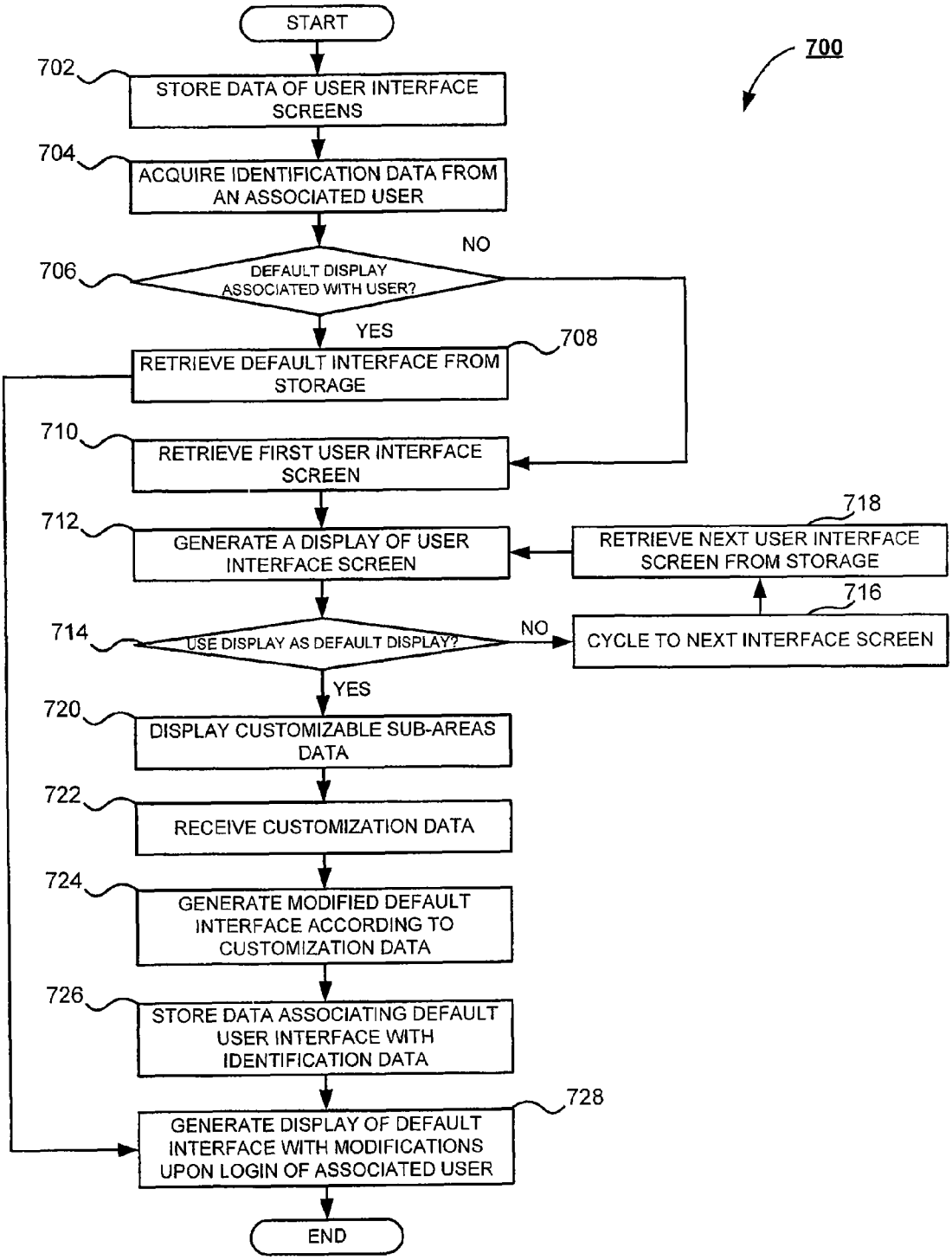
FIG. 7 is a flowchart illustrating a method for generating a user customizable default user interface for a document processing device according to one embodiment of the subject application.

Referring now to FIG. 7, there is shown a flowchart 700 illustrating a method for generating a user customizable default user interface for a document processing device in accordance with one embodiment of the subject application. The method described in FIG. 7 begins at step 702, whereupon data of each of a plurality of user interface screens are stored in a data storage device 110 associated with the document processing device 104. Preferably, each user interface screen includes visual representations of a unique subset of controls associated with the operation of the document processing device 104. In accordance with one embodiment of the subject application, suitable operations include, for example and without limitation, a copy operation, a print operation, a facsimile operation, an electronic mail operation, a scan operation, a storage operation, or the like.

Identification data is acquired from an associated user at step 704. The skilled artisan will appreciate that suitable identification data includes, for example and without limitation, a username, a password, biometric data, an alphanumeric sequence, or the like. A determination is then made at step 706 whether a default display is associated with the identification data. That is, the controller 108, or other suitable backend component of the document processing device 104 searches the associated data storage device 110 to determine whether default user interface data is stored in association with the received identification data. When such data is located, flow proceeds to step 708, whereupon the default interface is retrieved from the storage 110. Thereafter, a display of the default interface, with any associated modifications, is generated at step 728. It will be appreciated by those skilled in the art that when the user is accessing the document processing device 104 via the associated user interface 106, the default interface is displayed on the user interface 106. Accordingly, when the user is accessing the document processing device 104 remotely, such as from the user device 114 via the computer network 102, the user device 114 suitably displays the retrieved default user interface.

When it is determined at step 706 that no default user interface screen is stored in the data storage device 110 in association with the received identification data, flow proceeds to step 710, whereupon the first user interface screen, from among the plurality stored on the data storage device 110, is retrieved. It will be appreciated by those skilled in the art that the user is capable of manually selecting to update or otherwise modify the default screen interface via suitable options on the user interface 106 or via the interface displayed on the user device 114. Once the first screen has been retrieved, flow proceeds to step 712, whereupon a display of the user interface screen is generated for the user, e.g., on the user interface 106 or the user device 114. It will be appreciated by those skilled in the art that the user interface displayed to the user includes several customizable features, an example of which is evident in FIGS. 8-10, discussed in greater detail below.

A determination is then made at step 714 whether the user has selected the current interface screen as the default interface screen. For example, the user selects the screen via a suitable icon on the screen, the user makes no changes during a predetermined period of time, the user modifies one or more features on the screen, or the like. In the event that no such indication is received, flow proceeds to step 716, whereupon the controller 108, or other suitable backend component, cycles to the next screen stored in the data storage device 110. The next screen is retrieved from the data storage device 110 at step 718, and flow returns to step 712, whereupon the next screen is generated as a display to the user.

When it is determined at step 714 that the user has selected a desired screen from among those stored in the data storage device 110, flow proceeds to step 720. At step 720, customizable sub-areas are displayed. It will be understood by those skilled in the art that suitable customizable areas include, for example and without limitation, selectable graphics elements, icons, text boxes, graphical buttons, or the like. In accordance with one embodiment of the subject application, the customizable sub-areas are capable of being adapted in accordance with customization data that is received from the user. Thus, the user is able to select a particular icon, associate a document processing function with the icon, and a corresponding text description of the function associated with the icon. At step 722 customization data representing a modification to one of the customizable sub-areas is received from the associated user. For example, the user selects a particular icon for inclusion into the sub-area, adds a text description, selects an associated function to be represented in the sub-area, or the like.

Modified default interface data is then generated by the controller 108, or other suitable backend component of the document processing device 104, at step 724, according to the received customization data. The default user interface, inclusive of the customized features or elements associated with the interface, is then stored in the data storage device 110 at step 726 in association with the received identification data. Thereafter, a display of the default interface, inclusive of the customizations, is generated at step 728 upon login of the associated user.

Figure 8:
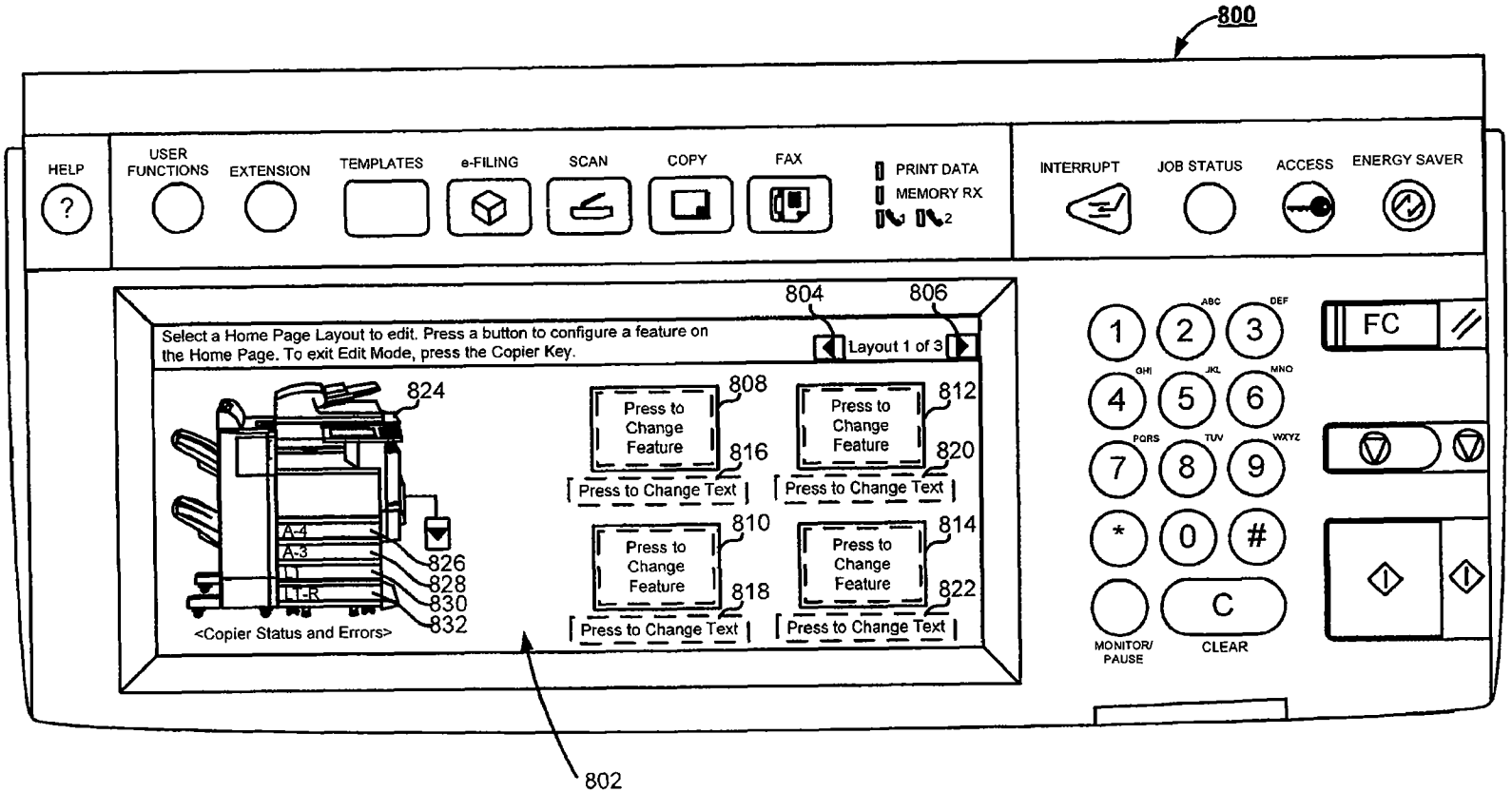
FIG. 8 is an example illustrating a user interface generated in accordance with a method for generating a user customizable default user interface for a document processing device according to one embodiment of the subject application.

Turning now to FIG. 8, there is shown a user interface 800 generated in accordance with one embodiment of the subject application. It will be understood by those skilled in the art that the user interface 800 is an example illustrating a user interface generated in accordance with the method for generating a user customizable default user interface for a document processing device in accordance with one embodiment of the subject application. As shown in FIG. 8, the user interface 800 includes a display 802, such as a touch-screen LCD display, suitably adapted to display a default user interface screen and customizable data related thereto. The display 802, representative of a first screen stored on the data storage device 110 of the document processing device 104 includes a plurality of sub-areas, shown as a first task icon 808, a second task icon 810, a third task icon 812, and a fourth task icon 814, each including an including an associated label 816, 818, 820, and 822, respectively. A graphic 824 of the associated document processing device 104 is also depicted in FIG. 8, showing the paper status, i.e., the paper available in the local paper trays via graphics for A-4 Paper (826), A-3 Paper (828), LT Paper (830), and LT-R Paper (832), along with the ability to change the default paper tray via the selection of the graphics 826, 828, 830, and 832, shown. It will be appreciated by those skilled in the art that the example interface 800 of FIG. 8 is capable of being employed by a user who frequently uses different paper sizes or changes paper sizes regularly.

Upon selection by the user of screen interface 800, the user is prompted to select suitable operations, descriptions, icons, and the like, corresponding to the sub-areas 808-822 illustrated in the display 802. The user is therefore able to customize the appearance and functionality of the default user interface screen via the sub-areas 808-822. In accordance with one embodiment of the subject application, the user is presented with a second screen, not shown, upon selection of the icon 808 illustrative of available features, or operations, of the associated document processing device 104. In such an embodiment, the user is presented with a third screen, not shown, illustrating a QWERTY or ABCD keyboard on the touch-screen display 802, enabling the user to quickly add narrative to the label 816. Once the user has made the modifications to the screen interface 800, the data is thereafter stored in the data storage device 110 in association with the identification data received from the user. This enables the retrieval and display of the modified screen 800 upon login of the user.

In order to change the display 802 to the next stored user interface screen, the user selects the next icon 806 to cycle to the next stored screen interface on the data storage device 110. To return to the previous screen, the user selects the back icon 804, whereupon the display 802 returns to the previous screen interface stored on the data storage device 110. In accordance with one embodiment of the subject application, the display 802 is capable of being automatically cycled through each stored display, enabling the user to view all displays prior to the selection of a default setting.

Figure 9:
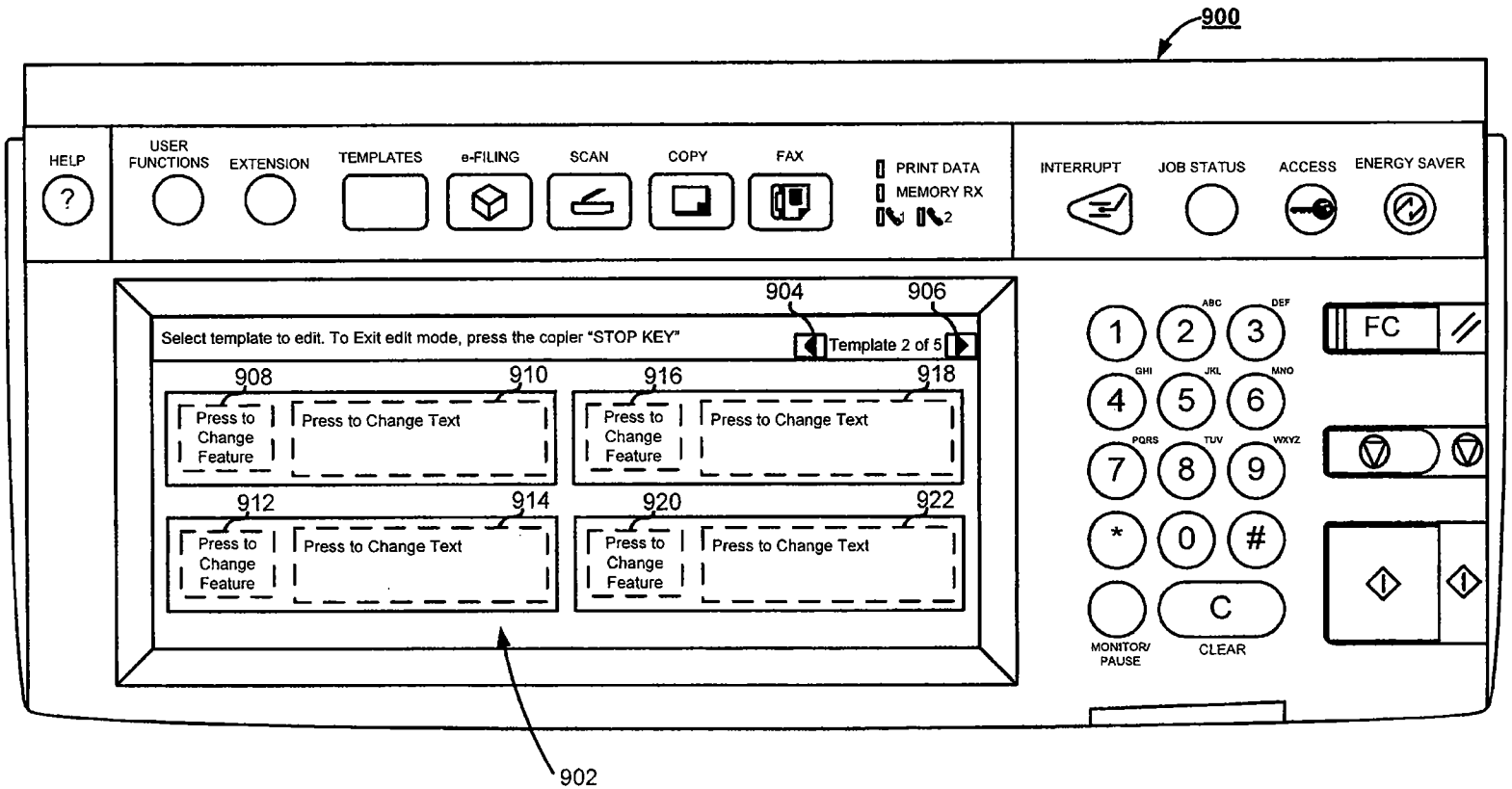
FIG. 9 is an example illustrating a user interface generated in accordance with a method for generating a user customizable default user interface for a document processing device according to one embodiment of the subject application.

Referring now to FIG. 9, there is shown an example illustrating a user interface 900 generated in accordance with the method for generating a user customizable default user interface for a document processing device in accordance with one embodiment of the subject application. Depicted in FIG. 9 is a screen interface 900 for a user requiring additional description of operations displayed on the default screen. The interface 900 includes a touch-screen LCD display 902, depicting a variety of sub-areas, as will be discussed in greater detail below. To facilitate the transition from one interface screen to another, the display 902 includes a back icon 904, to return to the previous screen retrieved from the storage device 110, and a next icon 906, to cycle to the next screen to be retrieved from the storage device 110 and displayed on the user interface 902.

The touch-screen LCD display 902 also includes eight user customizable sub-areas. The display 902 includes a first feature icon 908 and associated description field 910, a second feature icon 912 and associated description field 914, a third feature icon 916 and associated description field 918, and a fourth feature icon 920 and associated description field 922. Thus, the user selects the desired sub-area for modification, e.g., icon 908, and designates the feature to be associated with the icon.

For example, the user is capable of selecting a copying workflow feature, wherein a set number of copies, on a desired paper size are output. The user then selects the description field 910 and adds a desired narrative to describe the function designated by the feature icon 908. In accordance with one embodiment of the subject application, the user is presented with a second screen, not shown, upon selection of the icon 908 illustrative of available features of the associated document processing device 104. In such an embodiment, the user is presented with a third screen, not shown, illustrating a QWERTY or ABCD keyboard on the touch-screen display 902, enabling the user to quickly add narrative to the description field 910. Once the user has made the modifications to this template interface 900, the data is thereafter stored in the data storage device 110 in association with the identification data received from the user. This enables the retrieval and display of the modified screen 900 upon login of the user.

Figure 10:
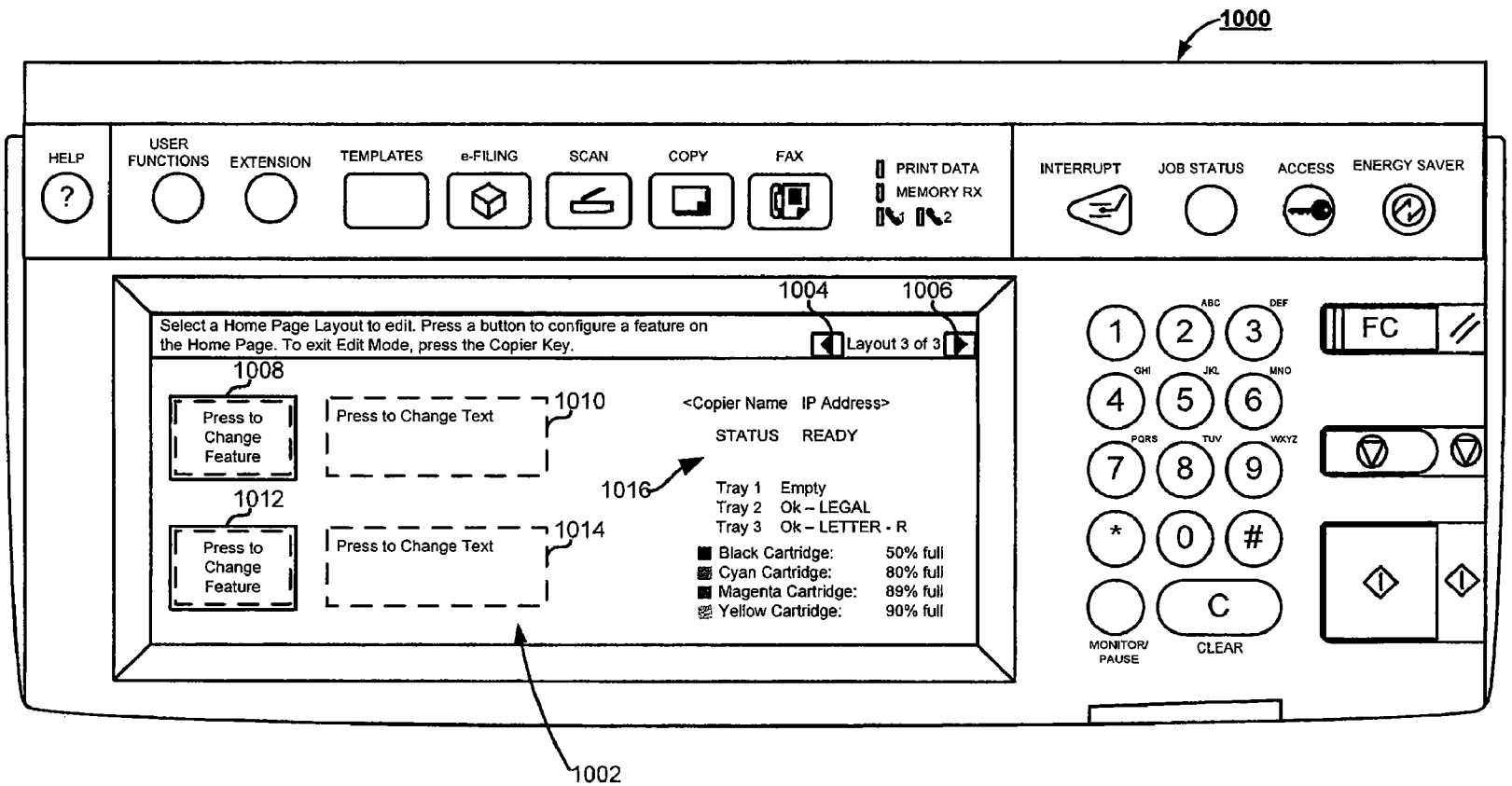
FIG. 10 is an example illustrating a user interface generated in accordance with a method for generating a user customizable default user interface for a document processing device according to one embodiment of the subject application.

FIG. 10 depicts an example illustrating a user interface 1000 generated in accordance with the method for generating a user customizable default user interface for a document processing device in accordance with one embodiment of the subject application. The interface 1000 depicted in FIG. 10 includes a touch-screen LCD display 1002, having a first feature icon 1008 and associated description field 1010, a second feature icon 1012 and associated description field 1014, and a document processing device status display 1016. The display 1002 further includes a back icon back icon 1004, to return to the previous screen retrieved from the storage device 110, and a next icon 1006, to cycle to the next screen to be retrieved from the storage device 110 and displayed on the user interface 1002.

It will be appreciated by those skilled in the art that the organization of the screen interface 1000 is illustrative of an example embodiment applicable to a user requiring advanced color information, a system administrator, or the like. As shown in FIG. 10, the display 1002 indicates various status data 1016 showing current document processing device 104 status, such as paper tray levels, toner or ink levels, and the like. The user is able to customize the display 1002 in the manner set forth above. Thus, the user selects the first feature icon 1008 and identifies a feature to be associated with the icon 1008. In accordance with one embodiment of the subject application, the user is presented with a second screen, not shown, upon selection of the icon 1008 illustrative of available features or operations capable of being performed on the associated document processing device 104. Following selection of the feature, the user is able to add a descriptive narrative to the icon 1008 by selecting the field 1010. In accordance with one particular embodiment of the subject application, a third screen, not shown, is displayed in the touch-screen display 1002 illustrating a QWERTY or ABCD keyboard, which enables the user to quickly add narrative to the description field 1010. Once the user has made the modifications to this template interface 1000, the data representing the selected interface and modifications are thereafter stored in the data storage device 110 in association with the identification data received from the user. This enables the retrieval and display of the modified screen 1000 upon login of the user.

The subject application extends to computer programs in the form of source code, object code, code intermediate sources and partially compiled object code, or in any other form suitable for use in the implementation of the subject application. Computer programs are suitably standalone applications, software components, scripts or plug-ins to other applications. Computer programs embedding the subject application are advantageously embodied on a carrier, being any entity or device capable of carrying the computer program: for example, a storage medium such as ROM or RAM, optical recording media such as CD-ROM or magnetic recording media such as floppy discs; or any transmissible carrier such as an electrical or optical signal conveyed by electrical or optical cable, or by radio or other means. Computer programs are suitably downloaded across the Internet from a server. Computer programs are also capable of being embedded in an integrated circuit. Any and all such embodiments containing code that will cause a computer to perform substantially the subject application principles as described, will fall within the scope of the subject application.

The foregoing description of a preferred embodiment of the subject application has been presented for purposes of illustration and description. It is not intended to be exhaustive or to limit the subject application to the precise form disclosed. Obvious modifications or variations are possible in light of the above teachings. The embodiment was chosen and described to provide the best illustration of the principles of the subject application and its practical application to thereby enable one of ordinary skill in the art to use the subject application in various embodiments and with various modifications as are suited to the particular use contemplated. All such modifications and variations are within the scope of the subject application as determined by the appended claims when interpreted in accordance with the breadth to which they are fairly, legally and equitably entitled.

What is claimed:

1. A system for generating a user customizable default user interface for a document processing device comprising:

a memory adapted for storage of screen data representative of each of a plurality of different user interfaces, each user interface including visual representations of a unique subset of controls associated with operation of an associated document processing device;

means adapted for generating a display representative of each of the plurality of user interfaces;

means adapted for receiving selection data representative of a selected one of the plurality of user interfaces as a default user interface;

storage means adapted for storing data associating the default user interface with acquired identification data; and means adapted for generating a display of the default user interface if acquiring identification data from an associated user on the associated document processing device.

2. The system for generating a user customizable default user interface for a document processing device of claim 1 further comprising:

means adapted for displaying data representative of customizable sub-areas of the default user interface;

means adapted for receiving, from the associated user, customization data representative of a modification to at least one of the customizable sub-areas; and means adapted for generating a modified default user interface in accordance with received customization data.

3. The system for generating a user customizable default user interface for a document processing device of claim 1 further comprising means adapted for cycling each of the plurality different user interfaces on an associated display prior to receipt of selection data.

4. The system for generating a user customizable default user interface for a document processing device of claim 2 wherein the customization data includes data representative of a selection of alternative icons associated with functions of the document processing device.

5. The system for generating a user customizable default user interface for a document processing device of claim 2 wherein the customization data includes text data associated with the default user interface.

6. A method for generating a user customizable default user interface for a document processing device comprising the steps of:

storing screen data representative of each of a plurality of different user interfaces, each user interface including visual representations of a unique subset of controls associated with operation of an associated document processing device;

generating a display representative of each of the plurality of user interfaces;

receiving selection data representative of a selected one of the plurality of user interfaces as a default user interface;

storing data associating the default user interface with acquired identification data; and generating a display of the default user interface upon if acquiring identification data from an associated user on the associated document processing device.

7. The method for generating a user customizable default user interface for a document processing device of claim 6 further comprising the steps of:

displaying data representative of customizable sub-areas of the default user interface;

receiving, from the associated user, customization data representative of a modification to at least one of the customizable sub-areas; and generating a modified default user interface in accordance with received customization data.

8. The method for generating a user customizable default user interface for a document processing device of claim 6 further comprising the step of cycling each of the plurality different user interfaces on an associated display prior to receipt of selection data.

9. The method for generating a user customizable default user interface for a document processing device of claim 7 wherein the customization data includes data representative of a selection of alternative icons associated with functions of the document processing device.

10. The method for generating a user customizable default user interface for a document processing device of claim 7 wherein the customization data includes text data associated with the default user interface.

11. A computer-implemented method for generating a user customizable default user interface for a document processing device comprising the steps of:

storing screen data representative of each of a plurality of different user interfaces, each user interface including visual representations of a unique subset of controls associated with operation of an associated document processing device;

generating a display representative of each of the plurality of user interfaces;

receiving selection data representative of a selected one of the plurality of user interfaces as a default user interface;

storing data associating the default user interface with acquired identification data; and generating a display of the default user interface upon if acquiring identification data from an associated user on the associated document processing device.

12. The computer-implemented method for generating a user customizable default user interface for a document processing device of claim 11 further comprising the steps of:

displaying data representative of customizable sub-areas of the default user interface;

receiving, from the associated user, customization data representative of a modification to at least one of the customizable sub-areas; and generating a modified default user interface in accordance with received customization data.

13. The computer-implemented method for generating a user customizable default user interface for a document processing device of claim 11 further comprising the step of cycling each of the plurality different user interfaces on an associated display prior to receipt of selection data.

14. The computer-implemented method for generating a user customizable default user interface for a document processing device of claim 12 wherein the customization data includes data representative of a selection of alternative icons associated with functions of the document processing device.

15. The computer-implemented method for generating a user customizable default user interface for a document processing device of claim 12 wherein the customization data includes text data associated with the default user interface.

* * * * *